US007604196B2

(12) United States Patent
Bordignon et al.

(10) Patent No.: US 7,604,196 B2
(45) **Date of Patent: *Oct. 20, 2009**

(54) DEVICE AND METHOD FOR FORMING COILS OF ROLLED OR DRAWN LONG PRODUCTS

(75) Inventors: Giuseppe Bordignon, Bicinicco (IT); Ivan Paiaro, Ronchi dei Legionari (IT); Andrea De Luca, Remanzacco (IT); Alfredo Poloni, Fogliane Redipuglia (IT)

(73) Assignee: Danieli & C. Officine Meccaniche SpA, Buttrio (UD) (IT)

( * ) Notice: Subject to any disclaimer, the term of this patent is extended or adjusted under 35 U.S.C. 154(b) by 352 days.

This patent is subject to a terminal disclaimer.

(21) Appl. No.: 10/597,262

(22) PCT Filed: Jan. 18, 2005

(86) PCT No.: PCT/IB2005/000105

§ 371 (c)(1),
(2), (4) Date: Jul. 18, 2006

(87) PCT Pub. No.: WO2005/039794

PCT Pub. Date: May 6, 2005

(65) Prior Publication Data

US 2008/0217463 A1 Sep. 11, 2008

(30) Foreign Application Priority Data

Jan. 19, 2004 (IT) ..... UD2004A0007

(51) Int. Cl.
*B65H 65/00* (2006.01)
*B65H 19/28* (2006.01)

(52) U.S. Cl. ..... 242/476.1; 242/586; 242/587

(58) Field of Classification Search ..... 242/362, 242/362.2, 571, 576, 576.1, 407, 470, 579, 242/580, 587, 587.2, 472.5, 476.1
See application file for complete search history.

(56) References Cited

U.S. PATENT DOCUMENTS

| | | | | |
|---|---|---|---|---|
| 3,527,077 | A | 9/1970 | Nargang | |
| 3,592,399 | A | 7/1971 | Woodrow | |
| 3,945,585 | A | 3/1976 | Moslener | |
| 7,246,767 | B2 * | 7/2007 | Castellani | 242/476.6 |

FOREIGN PATENT DOCUMENTS

| | | |
|---|---|---|
| DE | 26 49 340 A | 5/1978 |
| EP | 1 126 934 A | 8/2001 |
| EP | 1 126 934 B1 | 3/2003 |

* cited by examiner

*Primary Examiner*—John Q. Nguyen
*Assistant Examiner*—Stefan Kruer
(74) *Attorney, Agent, or Firm*—Gottlieb, Rackman & Reisman, P.C.

(57) ABSTRACT

Coiling device ("R") and relative method for a windable long, metal product (10). The device ("R") comprises a mandrel (12) having a substantially circular transverse section and rotating around a horizontal, vertical or inclined axis, a containing element (13) to contain the metal product (10) arranged in correspondence with the mandrel (12) and substantially orthogonal to the axis, and at least a guide and containing device (15, 16) able to be driven between a first working position wherein it cooperates with the mandrel (12), and a second inactive position wherein it is arranged distant from the mandrel (12). The containing element (13) comprises an annular channel (14) made in proximity with an outer surface of the mandrel (12). The guide and containing device (15, 16) comprises a groove (20) which defines an accompanying guide for the metal product (10) along an outer circumference of the mandrel (12) towards the annular channel (14), when the guide and containing device (15, 16) is in the first working position.

15 Claims, 3 Drawing Sheets

DEVICE AND METHOD FOR FORMING COILS OF ROLLED OR DRAWN LONG PRODUCTS

FIELD OF THE INVENTION

The present invention concerns a coiling device and the relative method for long metal products, ferrous or not, as obtained from drawing or rolling operations, whether done hot or cold. To be more exact, the invention concerns the coiling of wire, bars, flat strips, rods (smooth or ribbed), or tubes, having a transverse section that is round, square, rectangular, hexagonal or otherwise, of various sizes.

To be more exact, the invention concerns the device to guide and contain the coiled product, on the winding mandrel, in order to contain it laterally and to impose on the forming coil the desired external form. The winding mandrel may have a horizontal, vertical or inclined axis of rotation.

The invention is applied to coiling machines with cantilevered axis.

BACKGROUND OF THE INVENTION

In the state of the art, the problems connected to coiling, on a continuously rotating mandrel, a long metal product, either rolled or drawn, traveling at high speed, to be wound in contiguous, adjacent and superimposed spirals, in a uniform manner, so as to form very compact coils, are known.

It is known that the operation to form the coil, so that the spirals are compact and uniformly distributed in every layer and for the whole longitudinal extension of the coil, is very delicate.

The problem of easily removing the finished coils from the mandrel is also known.

If the operation to remove the coil is not carried out correctly, defects may occur in the finished coils, such as for example the wound spirals may be released and/or the coiled roll may have a bad aesthetic appearance. Moreover, if the coil does not have a regular geometry, there are problems of stacking during the storage step, and also problems with installing the coil on the machine which uses the same, and problems with the correct unwinding of the coiled product.

The European patent EP-B-1.126.934 discloses a coiling machine which comprises suitable guides, substantially semi-cylindrical in shape, otherwise known as flaps or insertion blades. Said guides are able to intercept the metal product to be wound, as it arrives from the rolling mill or the drawing machine, and are able to facilitate the formation of the first spirals of the coil on the mandrel. This known coiling machine, which has the axis of the mandrel cantilevered, also comprises a mobile containing plate to frontally contain the coil, which plate cooperates with the terminal, cantilevered part of the mandrel, and which can be arranged in the following two limit positions: a first position for the formation of the coil, wherein the containing plate is orthogonal to the axis of the mandrel and coaxial therewith, and a second position wherein the containing plate is rotated by about 90° and arranged substantially parallel to the axis of the mandrel, in a position of non-interference with the path on which the finished coil is discharged.

Before starting to distribute the spirals on the mandrel, it is necessary that the metal product to be wound is correctly gripped on the mandrel itself; to this purpose, it is necessary to provide a device that performs the clamping of the metal product to the mandrel with great reliability, precision and repeatability.

The U.S. Pat. No. 3,592,399 discloses an apparatus to grip and wind the leading end, or head, of a rolled product onto a mandrel, rotating around a horizontal axis, which is provided with a first containing plate to contain the coil to be formed, arranged perpendicular to the mandrel, and with a second containing plate to contain the coil laterally. This second plate is autonomous and movable with respect to the mandrel between an operating position, wherein it is parallel to the first plate, and an extraction position, wherein it is arranged distant from the mandrel and rotated laterally by 90° with respect thereto. To be more exact, the second plate is mounted rotatable on a cylindrical supporting element, which in turn can rotate on a vertical support. In order to facilitate the beginning of the formation of the coil, the second containing plate has an axis of rotation which does not coincide with that of the mandrel and is provided with an annular groove which has a circular surface eccentric with respect to the outer surface of the mandrel. Due to the misalignment of the second containing plate and the mandrel, the two surfaces form a clamping channel with a variable section, into which the leading end of the rolled product to be wound enters and is locked. Moreover, in order to facilitate the clamping of the head at the start of the winding operation, the apparatus comprises a guide element, substantially semi-circular in shape, which in the operating position cooperates with the aforesaid clamping channel until the first spirals have been wound onto the mandrel. After some spirals have been formed, the guide element is distanced from the mandrel and raised to an inactive position. This apparatus does not allow to obtain a clamping of the leading end which is repeatable and reliable. If clamping does not occur, then we have a relative sliding occurs between the rolled product and the mandrel, so that coiling cannot begin. On the other hand, if the leading end becomes detached from the clamping channel, after the formation of a few coils (with the mandrel under torque and the rolled product already flowing), the tension of the coils is released, there is a consequent slippage between the parts and hence a blockage is created upstream of the coiling device, with all the problems that derive from this. Such a detachment during the coiling step is also facilitated by the progressive cooling of the rolled product which begins to shorten as it shrinks, starting from the leading end, thus causing a drawing effect that causes the leading end to come out of the gripping channel.

It is therefore of fundamental importance to be able to guarantee a secure and long-lasting clamping of the initial segment of the rolled product on the mandrel.

One purpose of the present invention is to achieve a coiling device for long metal products which will guarantee a considerable rapidity in installing the mobile frontal containing means that cooperate with the end part of the mandrel.

Another purpose of the invention is to guarantee the correct performance of the coiling process.

Another purpose pursued by the device according to the invention is to improve the quality of the final coil in terms of winding, compactness, density and holding capacity of the spirals.

A further purpose of the invention is to prevent damage and a reduced quality of the product.

It is also a purpose of the invention to simplify maintenance operations on said device.

The advantages achieved give a coil having a desired geometric profile which allows to exploit the storage space, also in height, to optimize the handling and transport steps, and gives a better functioning to the user machines, which can thus work at greater speed.

Applicant has devised, tested and embodied the present invention to overcome the shortcomings of the state of the art and to obtain these and other purposes and advantages.

SUMMARY OF THE INVENTION

The present invention is set forth and characterized in the main claims, while the dependent claims describe other characteristics of the present invention or variants to the main inventive idea.

In accordance with the above purposes, a coiling device for long products, whether they be rolled or drawn, according to the present invention is provided with a guide and containing device which has the characteristics as in claim 1.

The purposes are achieved also by means of a coiling method for the long metal product which has the characteristics of claim 13.

The device and method according to the present invention are applied to machines for coiling long metal products, obtained from rolling or drawing operations, whether performed hot or cold. The products can be irrespectively wire, bars, flat strips, rods (smooth or ribbed), tubes, both of ferrous material such as steels with low, medium or high carbon content, stainless steels, alloyed or other, and also non-ferrous material, such as aluminum, copper or other. The invention is applied to coiling machines or reeling machines which have a mandrel with a cantilevered axis.

Said long metal products can have any transverse section whatsoever, that is, round, square, rectangular, hexagonal or otherwise, particularly, but not restrictively, with diameters between 8 mm and 52 mm or, in the case of bars or flat strips, with a transverse section between 60 $mm^2$ (for example 20 mm×3 mm) and 1400 $mm^2$ (for example 70 mm×20 mm).

In the following description long metal product can be taken to mean any of the above products, and also any similar or comparable products, traveling up to more than 40-45 m/sec with an hourly production of 110 tonnes and more.

According to a first characteristic of the invention, the coiling device is provided with a clamping or gripping zone, to clamp or grip an initial portion of the metal product, which advantageously comprises an annular channel, or rotary channel, made in a containing element located at one end of the mandrel and rotating therewith. According to one embodiment, the containing element can be completely outside the mandrel, or partly inside it. Said annular channel can have a cylindrical or preferably a truncated cone shape, hence in a section along a plane passing through the axis of the mandrel, has a shape respectively rectangular, square or preferably trapezoid or wedge-shaped. The sizes of the section of the channel are pre-defined and are such as to be able to lock in an initial portion of the metal product which is conveyed in it, so that sufficiently high forces are developed as to allow clamping to take place due to the sole effect of the friction. Therefore, it is not necessary to provide pincer means.

In order to ensure a more secure clamping action, a variant provides to include zones of improved adherence, made for example by means of a toothed or knurled surface, or an equivalent system, useful for improving the friction coefficient between the metal product to be wound and the mandrel.

In other words, the present invention provides the forced conveyance of the initial segment of the rolled product inside the annular channel by means of one or two opposite flaps which receive the wire from the distributor. The annular channel, which is made in a containing element located at one end of the mandrel and rotating therewith, has a truncated cone shape and cooperates with a knurled circular strip of the outer surface of the mandrel.

The annular channel, seen in section, has an inclined plane, that is, trapezoid, so that it allows to accept every difference in tolerance of the diameter of the rolled product, in any case guaranteeing that the product is clamped because it is forcibly locked into the wedge-shaped section and because of the friction on the annular toothing. This applies especially in the event that the rolled product to be coiled is a ribbed round bar for reinforced concrete which, due to the presence of the ribs, does not have a perfectly circular section, but slightly oval: the conformation of the channel thus allows to clamp the ribbed bar in any position that it arrives in, and hence with whatever transverse size it presents to the channel.

The clamping steps are performed substantially as follows.

The leading end of the metal product enters into a device to distribute the spirals from which it is introduced, tangentially with respect to the mandrel, into a guide and containing device, or flap, which contains the product and guides the leading end by means of a suitable groove.

This initial step of the winding, according to a variant, provides that the leading end of the product is conveyed by the groove of the flap inside the clamping zone.

The above-mentioned groove comprises a lateral wall which, at least in the flap that receives the leading end of the product, has an inclined or helical development, with an inclination sufficient to guide the leading end of the product towards the clamping zone. The groove with the inclined or helical wall can be limited to the upper flap, or to the lower flap, or can comprise at least part of both.

The flap which has the inclined groove can advantageously be the upper flap, but in some particular forms of embodiment of the coiling device it can be made in another flap, whatever the arrangement of the device in operation, for example with a horizontal, vertical or inclined axis of rotation.

According to another form of embodiment, on said containing element a flange is applied which is shaped so as to have an annular tooth substantially coaxial with the mandrel and which defines the annular clamping channel. The annular tooth allows to obtain coils without protruding spirals. In fact, once the coil is complete, the lateral surface of the latter, on the clamping side, will be perfectly plane and parallel to the other lateral surface, with all the advantages deriving therefrom, even if the coil itself has a circular hollow corresponding to the bulk of the annular tooth. The circular hollow, however, will be almost negligible and in any case irrelevant if compared with the overall volume of the coil.

BRIEF DESCRIPTION OF THE DRAWINGS

These and other purposes and advantages of the present invention will become apparent from the following description of a form of embodiment of a coiling device for metal products, given as a non-restrictive example with reference to the attached drawings wherein.

DETAILED DESCRIPTION OF SOME PREFERENTIAL FORMS OF EMBODIMENT

Hereafter, for the sake of simplicity, the metal product to be wound, whichever it may be of those named above, shall be called metal wire 10.

Figure 1:
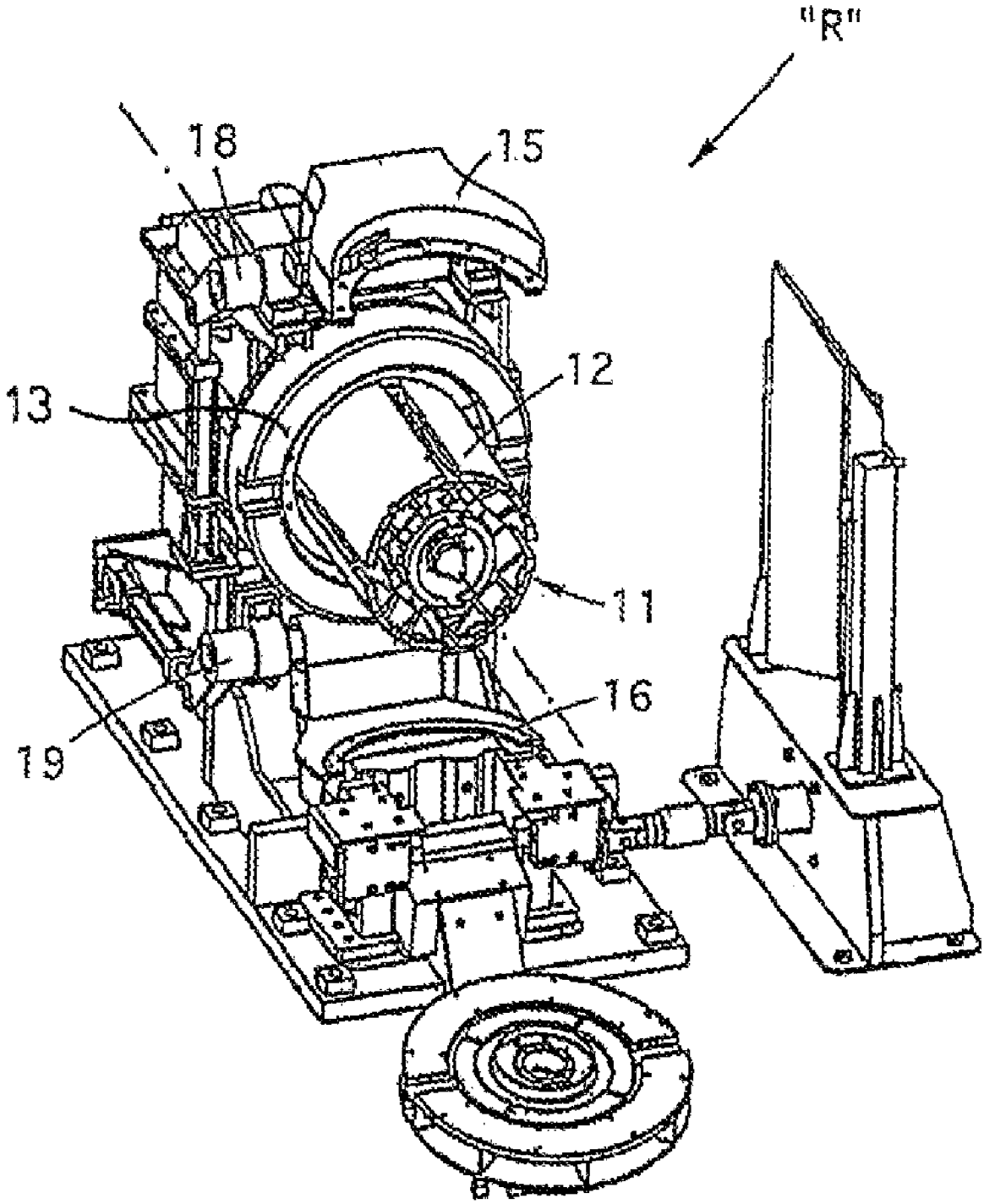
FIG. 1 is a perspective view of a coiling device according to the present invention, in this case with a horizontal axis.

With reference to the attached drawings, a coiling device "R" for metal wire 10 is arranged downstream of a production line, not shown here. The metal wire 10 is guided on a rotary reel 11 (FIG. 1) thanks to a known distribution device not shown here, which distributes it in a desired and uniform manner.

Figure 2:
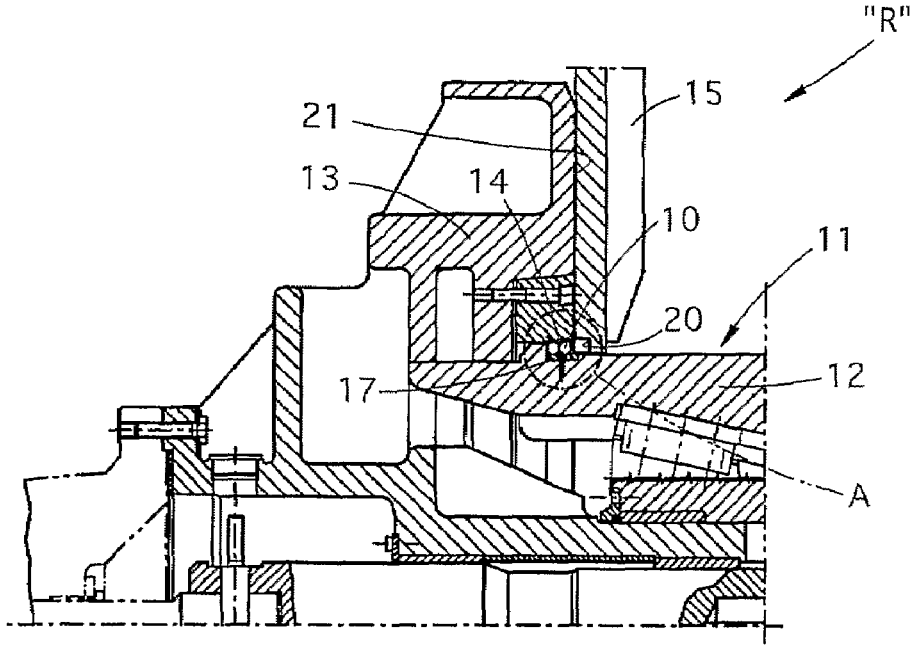
FIG. 2 shows a view in axial section of the device in FIG. 1.
Figure 3:
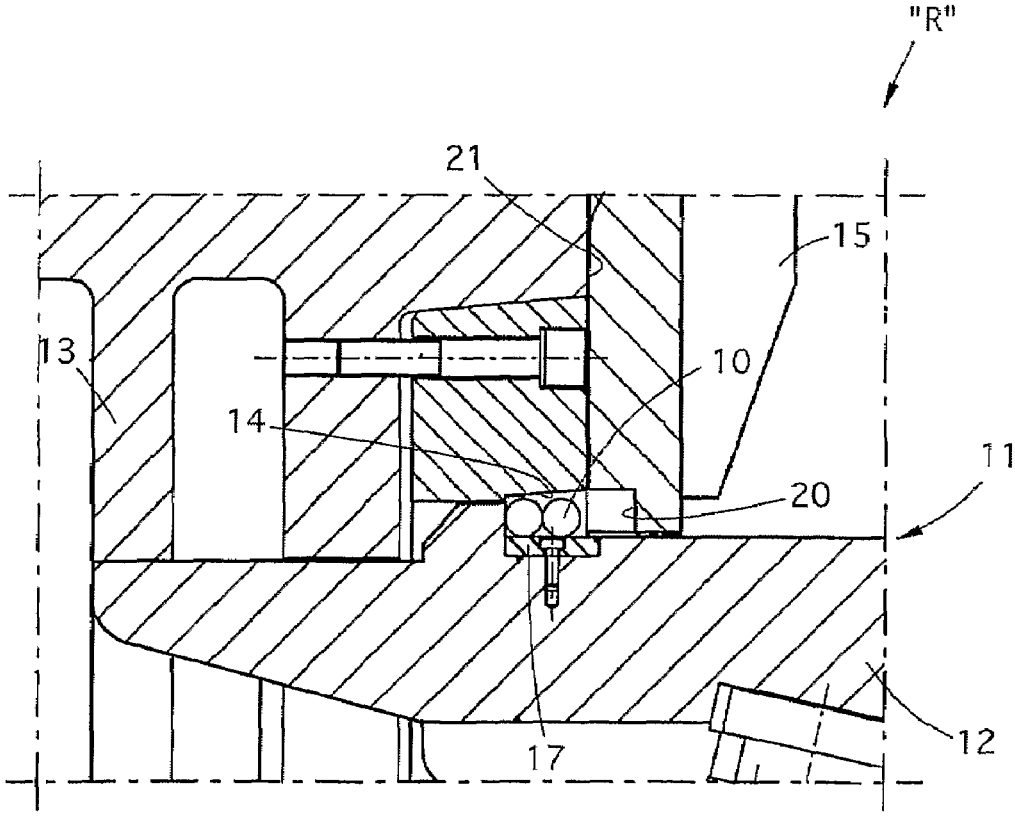
FIG. 3 shows a view in enlarged section of part A of FIG. 2.

The reel 11 comprises a mandrel 12 (FIG. 2), with which an inner plate 13 is associated, which defines one of the lateral walls 21 between which the coil is formed, and comprises an annular channel 14 in correspondence with the outer surface of the mandrel 12, which in the section view in FIG. 2 appears like a throat. The annular channel 14 is able to receive, at least for one or more spirals, the initial segment of the metal wire 10 which winds on the mandrel 12. In correspondence with the annular channel 14, the mandrel 12 advantageously but not necessarily includes a zone 17 with improved adherence on its outer surface. The coiling device "R" also comprises two guide and containing elements, or flaps, one upper 15 and one lower 16, able to be driven by respective actuation mechanisms 18, 19, to be taken to, or distanced from, a respective working position.

The upper flap 15 is provided with a guide or groove 20, through which the leading end of the metal wire 10 is guided in the winding operation during the first turns of the mandrel 12, sending it inside the annular channel 14 of the inner plate 13.

The coiling device "R" according to the invention also provides alternative forms of embodiment in which there is only one flap 15 or 16, in the zone of the mandrel 12 where it is necessary to start the winding. Alternatively, forms of embodiment are possible with more than two flaps, and which provide various types of mechanisms to distance the flaps or bring them together, whether the flaps are rotary or translating on a plane orthogonal to the axis of the mandrel 12.

Translation means can be provided in order to displace axially the inner plate 13 with respect to the mandrel 12 when the first layer of spirals has been formed, so that the other layers of spirals are exactly as wide as the first.

Figure 4:
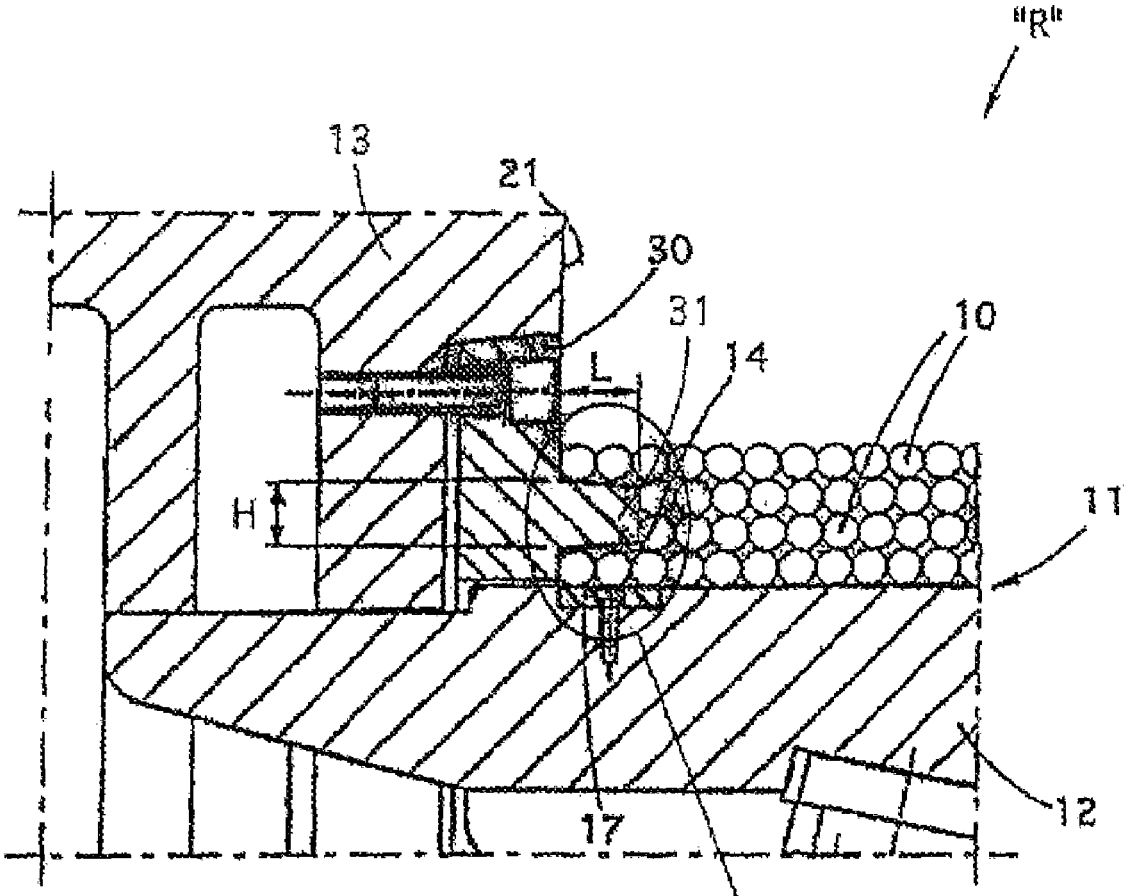
FIG. 4 shows a variant of the embodiment in FIG. 2.
Figure 4A:
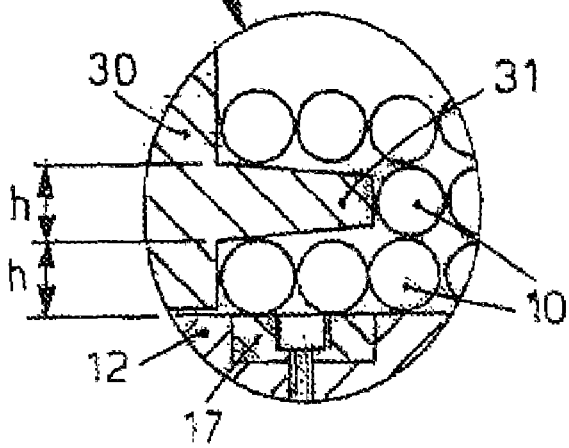

In accordance with a variant of the embodiment as described heretofore, a flange 30 is provided (FIG. 4) applied on the containing element 13 and shaped so as to have an annular tooth 31 substantially coaxial with the mandrel 12. The annular tooth 31 defines the annular channel 14.

The annular tooth 31 is slightly convergent towards the outside and advantageously has a thickness or height H substantially equal to the diameter of the metal wire 10, when the latter is of relatively large size, for example 16 mm or more, or equal to a multiple of the diameter of the metal wire 10 (as in the case shown in FIG. 4), when the latter is of relatively small size, for example 6 mm. In this second case the height H of the annular tooth 31 is for example 12 mm.

The protrusion or length L of the annular tooth 31 is substantially equal to a value of between 1.5 and 2 times the diameter of the metal wire 10.

The flange 30 can also be interchangeable according to the size of the metal wire 10 to be wound and is made in a material with great hardness, such as for example steel for tools.

The coiling device "R" functions as follows during the clamping steps.

First of all, the leading end of the metal wire 10 is made to enter into the groove 20 of the flap 15, and is deflected by a lateral wall, inclined or helical, which is able to guide the metal wire 10 towards the annular channel 14.

Subsequently, the leading end of the metal wire 10 enters the groove 20 of the flap 15 and continues winding the spirals which form the first layer of the coil. When the metal wire 10 has formed a sufficient number of spirals, according to its section size, it is firmly gripped by the mandrel 12 and it is therefore possible to open the flaps 15, 16 and start the distribution of the metal wire 10 on the mandrel 12 in order to complete the coil.

Thanks to the innovative characteristics of the coiling device "R" according to the invention, and particularly the synergy between the flap 15 which allows to start sending the metal wire 10 towards the annular channel 14, and the presence of the annular channel 14 itself, with its particular section, it is possible to clamp, rapidly and without mistakes, metal wires 10 arriving at high speeds, even more than 40-45 m/sec, without slowing down the speed of rotation of the reel 11 with an optimum arrangement of the spirals in the coil.

With the coiling device "R" according to the invention rolls or bars of great compactness and weight are obtained: the filling coefficient varies from 0.6 to 0.9 while the weight of the coil varies from 1500 to 5000 kg. The typical sizes of the coil are: inner diameter of between 700 mm and 900 mm, height between 700 mm and 900 mm, outer diameter variable according to the inner diameter, the height, the weight and the filling coefficient of the coiled roll.

It is clear, however, that modifications and/or additions of parts may be made to the coiling device "R" as described heretofore, without departing from the field and scope of the present invention.

It is also clear that, although the present invention has been described with reference to specific examples, a person of skill in the art shall certainly be able to achieve many other equivalent forms of coiling device and method for rolled or drawn products, all of which shall come within the field and scope of the present invention.

The invention claimed is:

1. Device for coiling a windable long, metal product, comprising a mandrel having a substantially circular transverse section and rotating around a horizontal, vertical or inclined axis, a containing element to contain said metal product, arranged in correspondence with said mandrel and including at least a lateral wall at least partially extending substantially orthogonal to said axis, and at least a guide and containing device able to be driven between a first working position in which said guide and containing device cooperates with said mandrel, and a second inactive position in which said guide and containing device is arranged distant from said mandrel, wherein said lateral wall of said containing element defines, together with an outer surface of said mandrel, an annular channel which is coaxial with the axis of rotation of said mandrel, wherein said guide and containing device includes a groove that is able to define an accompanying guide for said metal product along an outer circumference of said mandrel towards said annular channel and coaxial with said annular channel, when said guide and containing device is in said first working position; and wherein a flange is applied on said containing element substantially perpendicular to said mandrel and shaped so as to have an annular tooth substantially coaxial with said mandrel, said annular tooth defining said annular channel at a lower part of said containing element.

2. Device as in claim 1, wherein said annular channel has a substantially rectangular transverse section.

3. Device as in claim 1, wherein said annular channel has a substantially trapezoid section.

4. Device as in claim 1, wherein said guide and containing device comprises at least a first flap.

5. Device as in claim 1, wherein said annular tooth includes an outside surface, wherein said annular tooth is slightly convergent towards the outside surface.

6. Device as in claim 1, wherein said annular tooth has a thickness substantially equal to the diameter of said metal product, or to a multiple thereof.

7. Device as in claim 1, wherein a length of said annular tooth is substantially equal to a value of between 1.5 and 2 times the diameter of said metal product.

8. Device as in claim 1, wherein said flange is interchangeable according to the size of said metal product.

9. Device as in claim 1, wherein said flange is made of material of great hardness.

10. Device as in claim 4, wherein said guide and containing device comprises a second flap arranged diametrically opposite said first flap.

11. Device as in claim 10, wherein said first and second flap constitute, in said first working position, a lateral cover to said annular channel.

12. Method for coiling a long metal product, performed by means of a coiling device which includes a mandrel having a substantially circular transverse section and rotating around a horizontal, vertical or inclined axis, a containing element to contain said metal product, arranged at one end of said mandrel and including at least a lateral wall at least partly extending substantially orthogonal to said axis, and at least one guide and containing device, able to be driven between a first working position in which said guide and containing device cooperates with said mandrel, and a second inactive position in which said guide and containing device is arranged distant from said mandrel, said method comprising the following steps:

a first step wherein a leading end of said metal product is inserted into a groove of said guide and containing device arranged in said first working position to guide said metal product along an outer circumference of said mandrel;

a second step wherein said metal product is guided by said groove inside an annular channel defined between said lateral wall of said containing element and an outer surface of said mandrel and coaxially with said axis of rotation of said mandrel;

a third step wherein an initial segment of said metal product is gripped and clamped in said annular channel by means of friction forces generated between said metal product and the walls of said annular channel;

a fourth step wherein said metal product is wound onto said mandrel for a pre-determined segment of length;

a fifth step wherein said guide and containing device is taken from said first working position to said second inactive position; and a sixth step wherein said metal product is wound for the remainder of its length; further comprising applying a flange on said containing element substantially perpendicular to said mandrel and shaped so as to have an annular tooth substantially coaxial with said mandrel, said annular tooth defining said annular channel at a lower part of said containing element.

13. Method as in claim 12, wherein during said first step, said metal product is inserted into said groove by means of a distributor of said metal product.

14. Method as in claim 13, wherein during said first step, said mandrel is in rotation around its own axis.

15. Method as in claim 12, wherein said segment of predetermined length is between a fraction of one spiral and three spirals.

* * * * *